United States Patent [19]

Arvin et al.

[11] Patent Number: 4,826,078

[45] Date of Patent: May 2, 1989

[54] WIRE-TO-TRACK-BASE RETAINER CLIP AND KEEPER

[75] Inventors: Paul Arvin, Huntington, W. Va.; John R. Langley, Ironton, Ohio

[73] Assignee: Imo Delaval Inc., Princeton, N.J.

[21] Appl. No.: 120,615

[22] Filed: Nov. 13, 1987

[51] Int. Cl.[4] ..... E01B 11/54

[52] U.S. Cl. ..... 238/14.14; 238/14.05; 238/310; 238/351; 238/378; 403/405.1; 403/397

[58] Field of Search ..... 238/14.14, 14.2, 14.7, 238/14.12, 14.1, 14.05, 14.5, 14.9, 14.15, 14.13, 14.11, 378, 351, 151, 310, 323; 403/387, 397, 405.1; 248/72, 74.2, 229, 231.8

[56] References Cited

U.S. PATENT DOCUMENTS 2,109,213 2/1938 Fearing ..... 403/397
2,529,153 11/1950 Hain ..... 238/14.14
4,365,744 12/1982 Moehren ..... 238/310

FOREIGN PATENT DOCUMENTS 494470 7/1953 Canada ..... 238/323

*Primary Examiner*—Andres Kashnikow
*Assistant Examiner*—Mark T. Le
*Attorney, Agent, or Firm*—Hopgood, Calimafde, Kalil, Blaustein & Judlowe

[57] ABSTRACT

Heat treated spring steel, electroplated with zinc, is formed into clips having a base portion that passes under the base of a railway rail and upstanding end sections that respectively engage and forcefully snap over the opposite lateral edges of the rail base flange. One clip has confronting semi-cylindrical extensions for overlying a section of bond wire to secure the latter in a bight configuration wrapped over the edge of the rail flange. Another clip has a semi-cylindrical extension for securing a section of bond wire to the base flange at the junction with the web of the rail. Angled notches in the edges of the clips provide small barbs that are bent out of the plane of the clip body to bite into the rail when assembled thereto for avoiding creep.

9 Claims, 3 Drawing Sheets

Fig. 1.
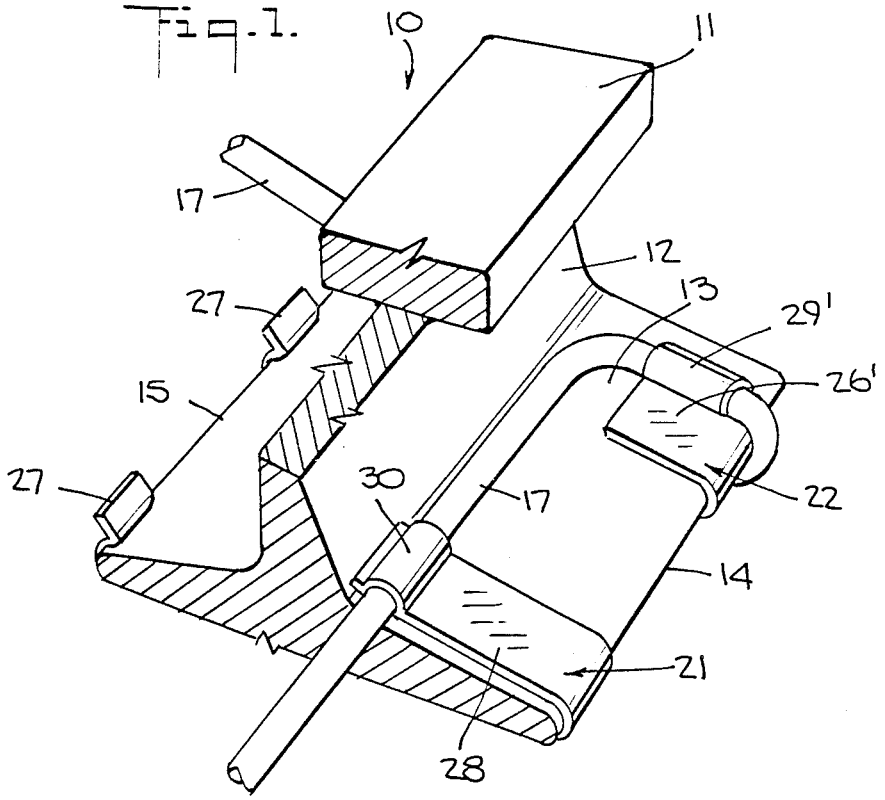
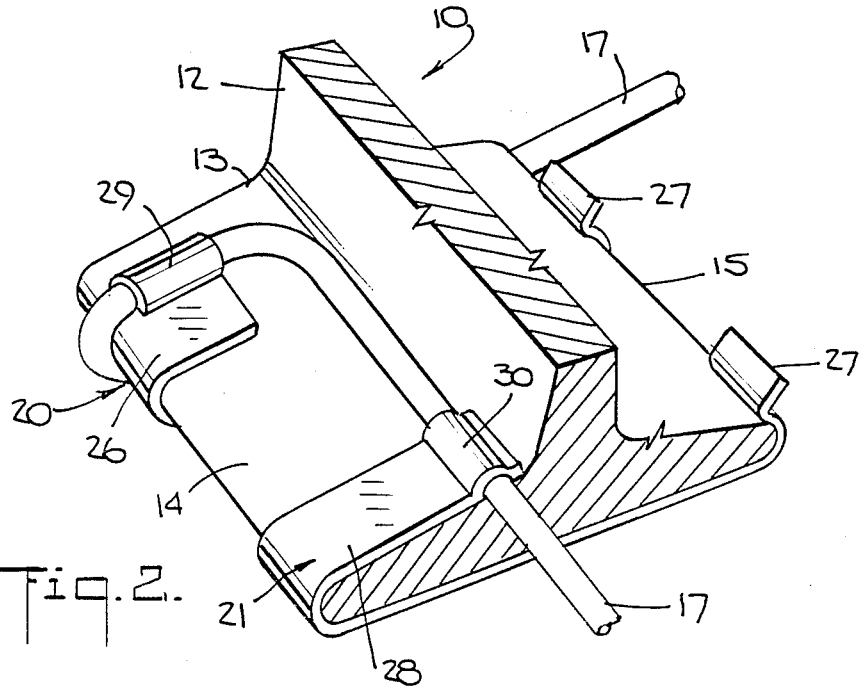
Fig. 2.

WIRE-TO-TRACK-BASE RETAINER CLIP AND KEEPER

BACKGROUND OF THE INVENTION

The present invention relates to railway track bonding wires and, more particularly, to the fastening devices for maintaining the wires in place adjacent the rail.

Generally in order to provide good electrical conductivity across joints in a track circuit it is necessary to bond the rail joint. This has been accomplished in the past by drilling a hole in each end of the rail and bridging the joint by one or more conductors known as bond wires. Usually the bond wires have sufficient slack that the wires are susceptible of being bent over onto the ball of the rail where they can be cut by the wheels of passing trains. Alternatively, they can be displaced down onto the ballast in which position they are likely to be damaged through the ignorance of the track men or torn from the rails by dragging rigging on the trains. Thus, for various reasons there has been a continuous need for clamps or the like to hold the wires in fixed safe position alongside the rail.

For this purpose, one railroad system employs a pair of fasteners, one a wire retaining clip and the other a wire keeper, for holding the bond wires in place. The devices consist of straps or strips fabricated from mild steel that has been zinc coated by dipping in molten zinc. The known retaining clip has one end consisting of a rectangular section of sheet metal, a rectangular aperture centered in the rectangular section, the rectangular section being bent U-shape with the bend or bight of the "U" bisecting the aperture running in the short direction across the section. Two parallel elongated spaced apart rectangular legs of sheet metal extend from one short side of the rectangular section. Down the longitudinal centerline of the rectangular section, between the border of the aperture and the adjacent side of the rectangular section, the metal is formed semi-cylindrical so as to provide confronting channels for securing a bond wire in a bight configuration wrapped over the lateral edge of a rail flange.

In use, the known retainer is placed with its legs slipped under a rail base from one side so that the rail flange slips into the U-shape section, whereupon the free end of each leg is manually formed around the opposite side of the rail base and tapped down with a hammer. However, bending of the legs of the retainer around the rail base tends to crack the zinc coating exposing the base metal to the elements, and corrosion sets in prematurely. Also, the known retainers, being constructed of mild steel, are easily unbent from the rail base without the aid of tools and have been subject to vandalism. Vibration from passing rail cars and brush contact from track sweeping operations tend to cause the retainers to creep. Also, the bond wire keeper, a retainer with a single semi-cylindrical portion at its end intended to clamp the wire against the flange where it meets the web of the rail lacks sufficient tension to maintain adequate pressure on the bond wire to resist relative movement of the bond wire. Consequently, the wire is susceptible of "gapping" or otherwise becoming loose thereby subjecting the wire to potential damage from track and ballast maintenance operations.

It is, therefore, an object of the present invention to provide a bond wire retainer system that is vandal resistant.

Another object is to provide a retainer system that resists creep and displacement so as to retain its as-installed retention capacity.

Yet another object is to provide retaining clips and keepers that are more corrosion resistant than those heretofore available.

SUMMARY OF THE PRESENT INVENTION

In accordance with one aspect of the present invention there is provided a bond wire retention system for securing a bond wire to a railway rail comprising a clip for clamping a first portion of a bond wire to the upper surface of a rail flange, said clip being formed of heat treated spring steel and having a base section for underlying the base of said rail and upstanding sections at opposite ends of said base section which upstanding sections respectively engage and snap forcefully over the opposing lateral edges of the rail base flange with an interference fit requiring a tool for both attaching and detaching said clip from said rail base, said clip having a body section within one of its upstanding sections that embracingly follows the upper surface of said rail flange and from which extends a substantially semi-cylindrical section for snugly embracing said bond wire to secure said bond wire against said rail.

In accordance with another aspect of the present invention there is provided a bond wire retention system for securing a bond wire to a railway rail comprising in combination a first clip for clamping a first portion of a bond wire in a bight configuration about a lateral edge of a rail flange with said wire first portion closely following the upper and lower surfaces of said flange, and a second clip for clamping another portion of said bond wire to the upper surface of said rail flange adjacent the junction with the rail web, said clips being formed of heat treated spring steel and each having a base section for underlying the base of said rail and upstanding sections at opposite ends of said base section which upstanding sections respectively engage and snap forcefully over the opposing lateral edges of the rail base flange with an interference fit requiring a tool for both attaching and detaching said clips from said rail base, said clips each having a body section within one of its upstanding sections that embracingly follows the upper surface of said rail flange and from which extends a substantially semi-cylindrical section for snugly embracing said bond wire to secure said bond wire against said rail.

BRIEF DESCRIPTION OF THE DRAWINGS

The invention will be better understood after reading the following detailed description of the presently preferred embodiments thereof with reference to the appended drawings in which:

FIG. 1 is a sectioned fragmentary perspective view showing the installation of clips embodying the present invention along a length of bond wire with the wire coming up from under the rail on the right and running toward the left;

FIG. 2 is a view similar to FIG. 1, but showing the clips installed with the wire running in the opposite direction;

The same reference numerals are used throughout the drawings to designate the same or similar parts.

DETAILED DESCRIPTION OF THE PRESENTLY PREFERRED EMBODIMENTS

Figure 3:
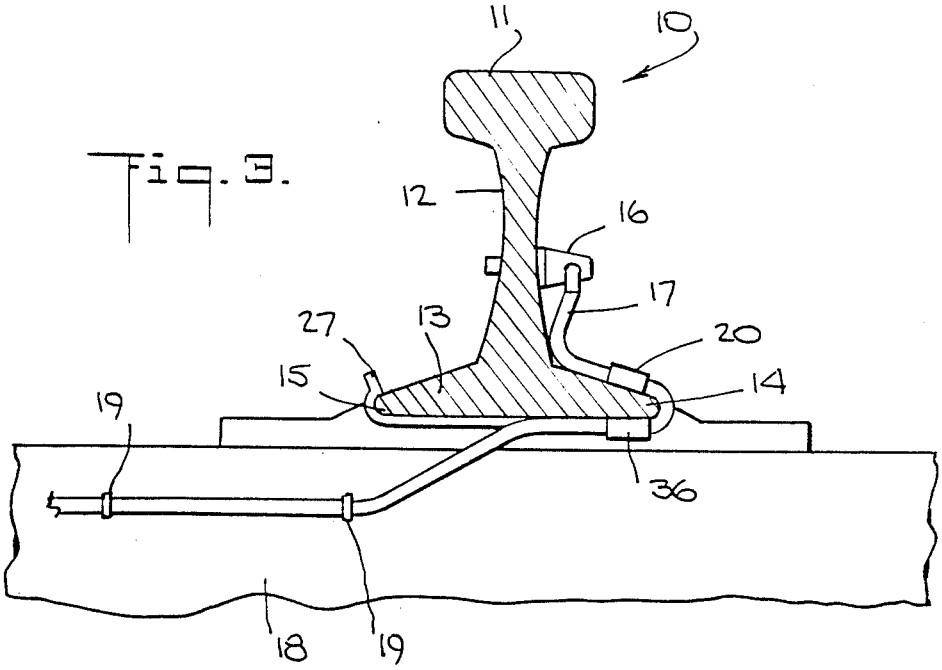
FIG. 3 is a sectional view of another section of a bond wire showing the track connection.

Referring now to FIGS. 1, 2 and 3, there is shown a section of railway rail, designated generally by the reference numeral 10, having a ball 11 at the top of a web 12 that merges with a base flange 13 having lateral edges 14 and 15, all of conventional construction. Each of the FIGS. 1, 2 and 3 illustrates a slightly different installation using the clips of the invention. Thus, in FIG. 3, there is shown a terminal connection of a bond wire with a track connector 16 secured in the web 12 to which is connected a bond wire 17 that is brought down and runs along the upper surface of the rail flange 13 to the lateral edge 14 where it is turned in a bight and brought beneath the rail base where it is dressed along the side of a tie 18 to which it is secured by wire staples 19. A clip 20, the details of which will be described below, secures the wire 17 in the bight configuration wrapped around the rail base.

In FIGS. 1 and 2, the bond wire is shown traversing beneath the rail, on the right side in FIG. 1 and on the left side in FIG. 2, whereupon it is brought into a bight configuration to come up onto the upper surface of the flange 13 and travel laterally or longitudinally along the length of the rail in the junction between the web and the flange to be secured to the rail by the clip 21. In FIG. 1, the clip that retains the wire in a bight configuration is designated by the numeral 22 in order to distinguish it from the clip 20 in FIG. 2. Clips 20 and 22 are almost identical with the exception that one is a mirror image of the other so as to locate the bight on the right side of the clip 22 and on the left side of clip 20.

It will be seen that a system is illustrated in FIGS. 1 and 2 for securing a bond wire to a railway rail that includes a first clip 20 or 22 for clamping a portion of the bond wire 17 in a bight configuration about a lateral edge of the rail flange 13 with a portion of the wire closely following the upper and lower surfaces of the flange. A second clip, the clip 21, is provided for clamping another portion of the bond wire to the upper surface of the rail flange 13 adjacent the junction with the rail web 12. The clips are formed of heat treated spring steel electroplated with a zinc protective coating and, as best seen in FIG. 4 to 9, each clip has a base section 25 for underlying the base 13 of the rail 10, and upstanding sections, such as sections 26 and 27 of FIG. 4, or section 28 of FIG. 8, at opposite ends of the base section 25 which upstanding sections respectively engage and snap forcefully over the opposing lateral edges of the rail base flange with an interference fit that requires a tool such as a pry bar or the like for both attaching and detaching the clips from the rail base. Both the clips of FIGS. 4 and 8 have a body section within one of its upstanding sections, namely, the section 26 or 28, that embracingly follows the upper surface of the rail flange 13 and from which extends a substantially semi-cylindrical section, 29 or 30, respectively, for snugly embracing the bond wire 17 to secure the bond wire against the rail.

Figure 5:
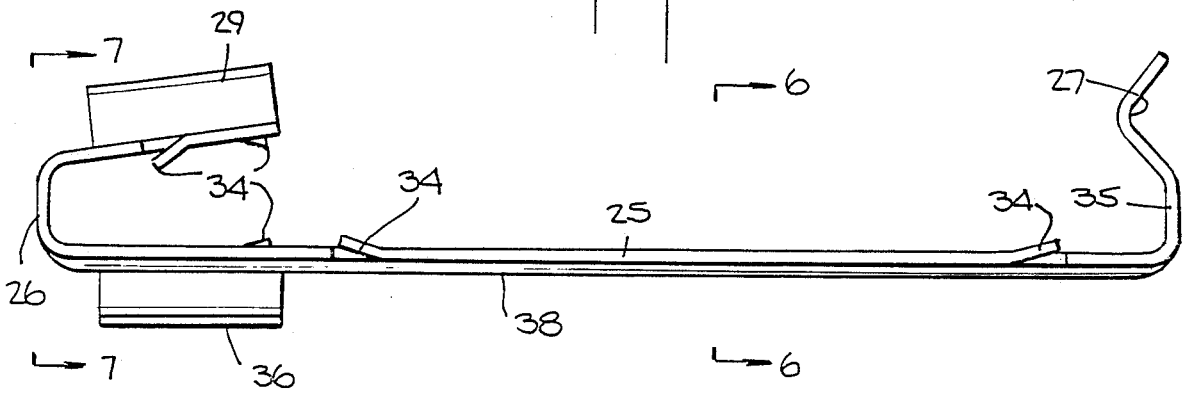
FIG. 5 is a side elevational view of the clip in FIG. 4.
Figure 6:
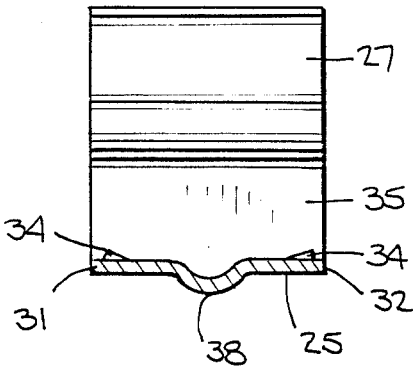
FIG. 6 is a transverse sectional view taken along line 6—6 in FIG. 5.
Figure 7:
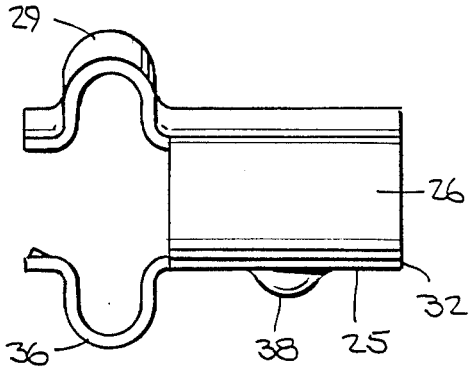
FIG. 7 is an end elevational view as seen in the direction of the arrows 7—7 in FIG. 5.

The clips have side edges 31 and 32 from which short slits 33 extend into the body of the clip at an acute angle to the longitudinal axis of the clip to provide triangular regions which are bent from the general plane of the clip body to produce barbs 34, best seen in FIG. 5, for example, which barbs bite into the metal of the rail when the clips are assembled thereto.

Figure 4:
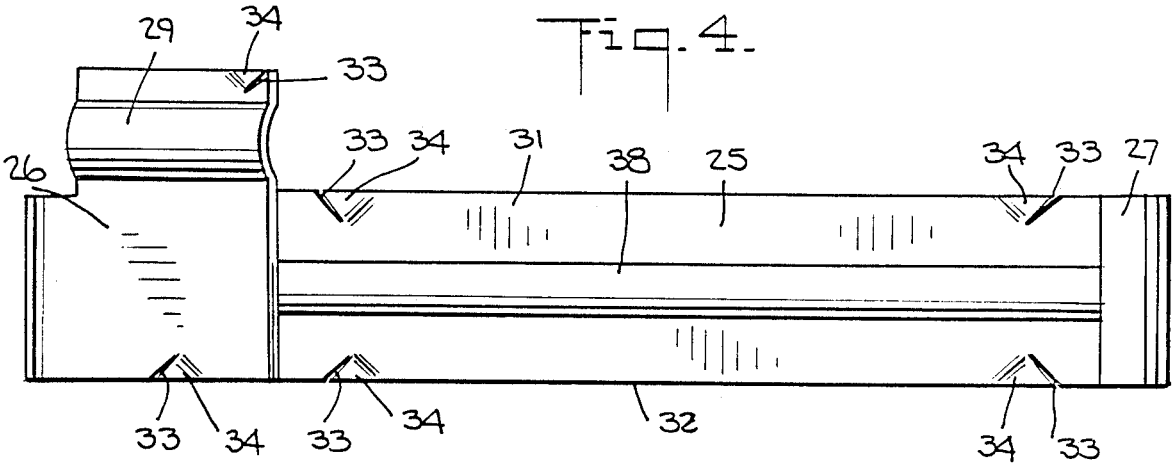
FIG. 4 is a top plan view of a one of the clips used in the installation of FIG. 2.

Referring to FIGS. 4 and 5 it will be observed that the upstanding sections 27 of the clips that do not contain the body section are formed generally S-shaped with the portion of the S-shape that is adjacent said clip base, namely, the portion 35 facing with its concavity directed inwardly of the clip for accommodating a rail base lateral edge. This is best seen in FIGS. 1, 2 and 3.

Also as seen in FIG. 4, the semi-cylindrical section 29 extends from the body section 26 laterally relative to the longitudinal axis of the clip base section 25. On the other hand, as seen in FIGS. 8 and 9, the semi-cylindrical section 30 extends from the body section 28 longitudinally relative to the longitudinal axis of the second clip base section.

Referring again to FIGS. 4, 5 and 7, it will be seen that the clip therein includes another semi-cylindrical section 36 that extends laterally from the base section 26 on the same side as the semi-cylindrical section 29 but with the concavity of the section 36 facing the concavity of the section 29 for the purpose of securing a first portion of the bond wire in a bight configuration.

Figure 8:
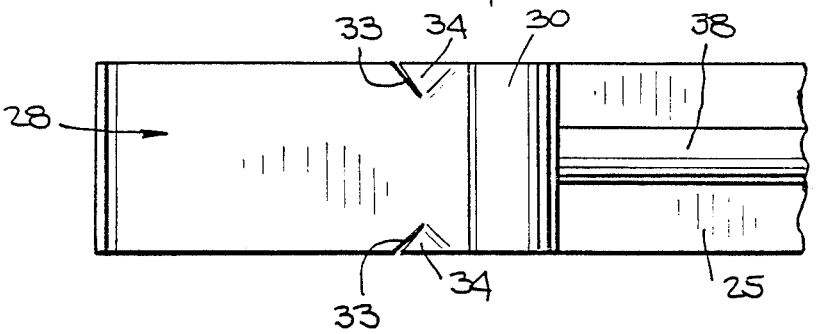
FIG. 8 is a fragmentary top plan view of the other clip seen in FIG. 2, but showing only so much as differs from the clip of FIG. 4.
Figure 9:
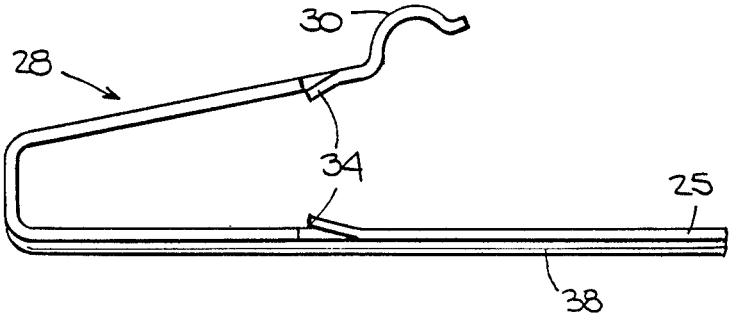
FIG. 9 is a side elevational view of the clip shown in FIG. 8.

It is to be understood that the clip of FIGS. 8 and 9 has an identical end 27 to the clip shown in FIGS. 4 and 5. Only the portion illustrated in FIGS. 8 and 9 differs from the clip shown in FIGS. 4 and 5.

In order to strengthen the base section 25, the latter is provided with a longitudinal channel or rib 38.

By way of summary, the clips described above are formed from hardened spring steel material provided with a protective electroplated surface coating. Since there is no need to significantly bend any of the metal of the clip, the plating remains intact so as to serve the corrosion resistence thereof. This is not deteriorated due to the slight springing apart of the upstanding sections when the clip is snapped over the lateral edges of the rail base.

Having described the present invention with reference to the presently preferred embodiments thereof, it will be understood that various changes in construction can be implemented by those skilled in the art without departing from the true spirit of the invention as defined in the appended claims.

What is claimed is:

1. A bond wire retention system for securing a bond wire to a railway rail comprising in combination a first snap-on-clip for clamping a first portion of a bond wire in a bight configuration about a lateral edge of a rail flange with said wire first portion closely following the upper and lower surfaces of said flange, and a second snap-on clip for clamping another portion of said bond wire to the upper surface of said rail flange adjacent a junction with a rail web, said clips being formed of heat treated spring steel and each having a base section for underlying the base of said rail and each having a return-bend upstanding section and a snap-on upstanding section at opposite ends of said base section which upstanding sections respectively engage and span forcefully over the opposing lateral edges of the rail base flange with an interference fit requiring a tool for both attaching and detaching said clips from said rail base, said return bend upstanding section having a body section that embracingly follows the upper surface of said rail flange and from which extends a substantially semi-cylindrical section for snugly embracing said bond wire to secure said bond wire against said rail, wherein said base sections and said body sections of said clips have side edges from which short slits extend into the body of the clip at an acute angle to the longitudinal axis of the clip to provide triangular regions which are bent from a general plane of the clip body to produce barbs which bite into the metal of said rail when the clips are assembled thereto.

2. A bond wire retention system according to claim 1, wherein said upstanding sections of said clips that do not contain said body section are formed generally S-shaped with the portion of the S-shape that is adjacent said clip base section facing with its concavity directed inwardly of the clip for accommodating a rail base lateral edge.

3. A bond wire retention system according to claim 2, wherein said semi-cylindrical section on said first clip extends from said body section laterally relative to the longitudinal axis of said first clip base section.

4. A bond wire retention system according to claim 3, wherein said semi-cylindrical section on said second clip extends from said body section longitudinally relative to the longitudinal axis of said second clip base section.

5. A bond wire retention system according to claim 1, wherein said upstanding sections of said clips that do not contain said body section are formed generally S-shaped with the portion of the S-shape that is adjacent said clip base section facing with its concavity directed inwardly of the clip for accommodating a rail base lateral edge.

6. A bond wire retention system according to claim 1, wherein said semi-cylindrical section on said first clip extends from said body section laterally relative to the longitudinal axis of said first clip base section.

7. A bond wire retention system according to claim 6, wherein said semi-cylindrical section on said second clip extends from said body section longitudinally relative to the longitudinal axis of said second clip base section.

8. A bond wire retention system according to claim 6, wherein said first clip includes another semi-cylindrical section extending laterally from its base section on the same side as the other semi-cylindrical section on said first clip and with the concavity of said another semi-cylindrical section facing the concavity of said other semi-cylindrical section to secure said first portion of said bond wire in said bight configuration.

9. A bond wire retention system according to claim 1, wherein said semi-cylindrical section on said second clip extends from said body section longitudinally relative to the longitudinal axis of said second clip base section.

* * * * *